United States Patent [19]

Nemitz et al.

[11] 4,245,685

[45] Jan. 20, 1981

[54] PROTECTIVE CARRIER

[75] Inventors: Russell H. Nemitz; Jewel J. Shelton, both of Raleigh, N.C.

[73] Assignee: Mallinckrodt, Inc., St. Louis, Mo.

[21] Appl. No.: 933,956

[22] Filed: Aug. 15, 1978

[51] Int. Cl.[3] ..... B65D 23/08; B65D 81/16; A47J 41/00

[52] U.S. Cl. ..... 150/52 R; 150/52 F; 215/12 R; 220/72; 220/91; 220/95; 220/306

[58] Field of Search ..... 215/1 C, 12 R, 12 A, 215/13 R, 13 A; 220/72, 91, 95, 306, 307; 150/0.5, 52 R, 52 P

[56] References Cited

U.S. PATENT DOCUMENTS

| | | | |
|---|---|---|---|
| 81,390 | 8/1868 | McLea | 220/91 |
| 1,677,222 | 7/1908 | Whitney | 220/95 |
| 2,181,150 | 11/1939 | Pittenger | 220/72 |
| 2,802,590 | 8/1957 | Tupper | 220/306 |
| 3,187,966 | 6/1965 | Klygis | 220/307 |
| 3,195,272 | 7/1965 | Mosher | 150/0.5 |
| 3,771,686 | 11/1973 | Brison | 215/1 C |
| 4,002,257 | 1/1977 | Hatridge | 150/52 R |
| 4,114,759 | 9/1978 | Maloney | 215/12 R |

FOREIGN PATENT DOCUMENTS

| | | | |
|---|---|---|---|
| 572560 | 11/1958 | Belgium | 215/12 R |
| 1486892 | 9/1977 | United Kingdom | 215/12 R |

OTHER PUBLICATIONS

Markson Science, Inc., 1978–1979, Science Supply Catalog, p. 162.

*Primary Examiner*—George E. Lowrance
*Attorney, Agent, or Firm*—Bernard & Brown

[57] ABSTRACT

A protective carrier for fragile containers which includes a domed lid which snap-fits onto a ribbed, generally cylindrical carrier body, a ribbed, flattened bottom, and an interlocking handle, and method of manufacture.

2 Claims, 5 Drawing Figures

FIG. 1
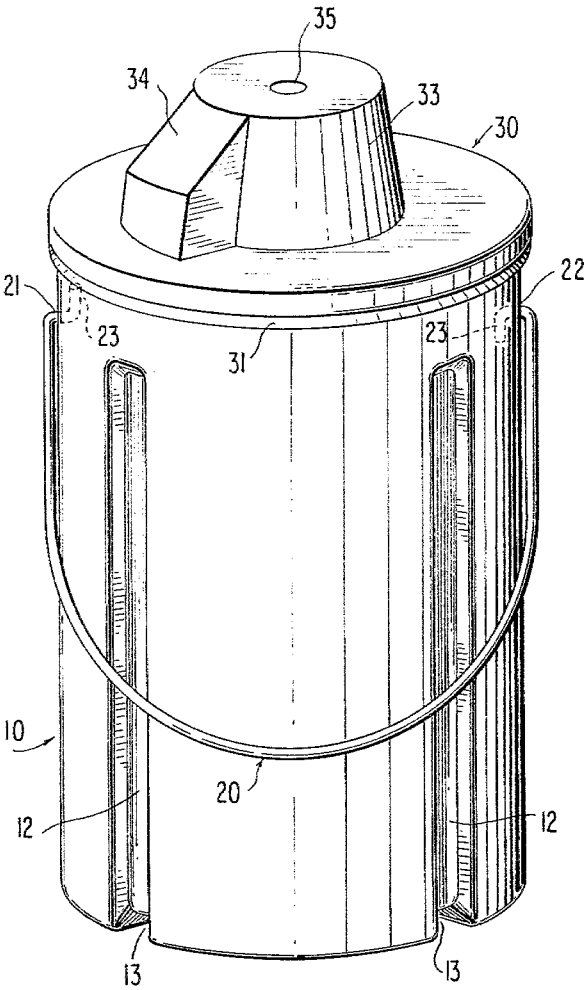
FIG. 2
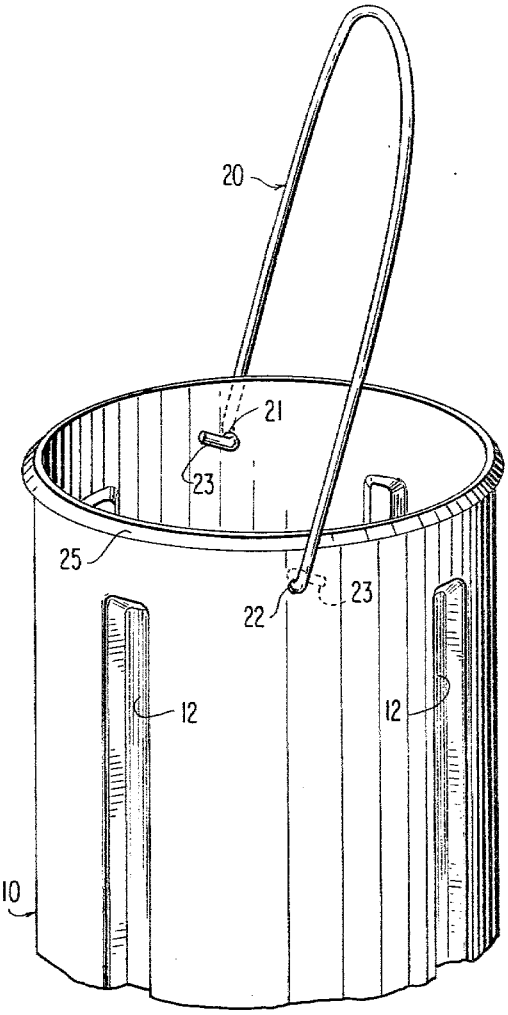
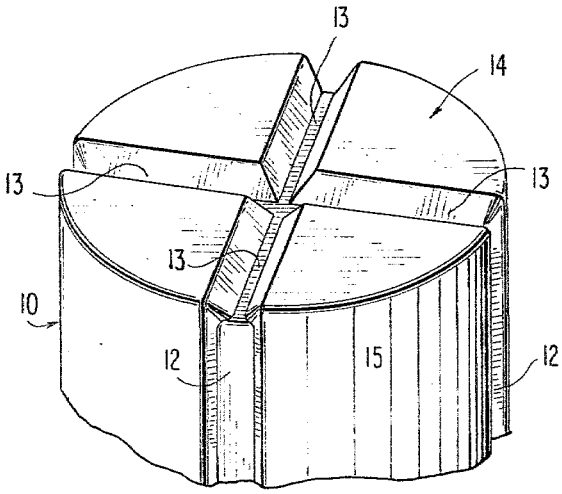
FIG. 3

PROTECTIVE CARRIER

BACKGROUND OF THE INVENTION

This invention relates to a plastic protective carrier for a breakable or otherwise fragil container, particularly a glass container used to store laboratory solvents, acids, or other fluids.

Containers used in the sale and storage of laboratory solvents are often made of glass for a variety of reasons. Glass possesses an inherent lack of chemical reactivity with most solvents, glass can be made transparent or relatively opaque depending upon the application, and glass is inexpensive to manufacture. However, glass containers are also easily broken by physical shock, and means must usually be provided to ensure that the glass container will be protected from bumps, falls, and other physical jostling, both during shipment and in the course of use in the laboratory. This is particularly important where the glass container is carrying a solvent which is corrosive, toxic, or is one which must be maintained at a precisely defined level of purity or chemical concentration, for in those cases any accidental spillage or unintended break in container integrity could have serious consequences in terms of safety, property damage, or experimental accuracy.

Protective carriers made of a semi-rigid plastic such as polyethylene have been used for this purpose, these carriers consisting essentially of a large bucket-like container, with a lid and a handle, into which the glass container may be placed. The polyethylene carrier is made to accommodate standard sized glass solvent containers with only a slight clearance, so that the glass container is held in a relatively stationary position within the container, and is protected from external shock by the walls of the carrier. In practice, inwardly-directed ribs are sometimes used in the walls and the bottom to position the container within the carrier, thereby allowing for a cushioning airspace between most of the inner wall of the carrier and the container.

Protective carriers of existing design, however, have not been totally satisfactory because of one or more shortcomings which relate either to their relative safety or ease of use.

SUMMARY OF THE INVENTION

The present invention provides an improved protective carrier in the form of a generally cylindrical body for housing a fragile container. The bottom of the carrier is integrally formed on one end of the body. The carrier is provided with a cover which includes a circumferential lip for engaging a cooperating circumferential flange on the top of the carrier body with a snap fit to hold the lid tightly onto the body. A handle with an interlocking feature is provided for the carrier.

The lid normally includes a generally truncated cone-shaped central portion. The inside surface of this central portion is dimensioned so as to accomodate a portion of the bottle neck which projects into this central portion. A keyway extends generally laterally from this central portion for housing the jug-type handle that is often included on the kind of containers that this carrier is intended to house. This keyway serves to protect the handle, and restrict rotational movement of the containers.

The body of the carrier has inwardly projecting ribs which extend generally in an axial direction for engaging the side of the container which is intended to be housed by the carrier. The inside diameter of the carrier is a predetermined amount greater than the outside diameter of the container intended to be housed so that an air space is provided between the container and the wall of the carrier. The ribs project inwardly a sufficient distance to restrict movement of the container so as to hold it in a relatively fixed position within the carrier.

The bottom of the carrier also has ribs which are aligned with the ribs on the body of the carrier for supporting the container above the bottom of the carrier. Although the ribs on the side of the body and the ribs on the bottom are usually aligned with one another to form a generally continuous indentation, it is possible that the bottom ribs could be angularly offset from the side ribs.

The side ribs have a generally U-shaped construction to provide a greater contact surface between the rib and the container. The bottom ribs have a generally rounded V-shaped cross section to provide greater strength for supporting the weight of the container.

The handle for the carrier projects through holes provided on generally opposing sides of the upper portion of the carrier. Each end of the handle has a serpentine configuration including a generally inwardly projecting, radially extending portion and a portion which extends generally tangentially to the circumferential direction. The tangentially extending portion of one side of the handle points in the opposite direction from that of the other end of the handle so as to minimize the possibility of the handle twisting loose from the carrier during use.

The upper surface of the truncated cone-shaped central portion of the carrier lid includes an access hole through which a siphon may be introduced. The carrier of the present invention therefore provides a shock-protection to the container not only during shipment but also while it is being used in the laboratory. The entire container is completely encased within the carrier so that even if laboratory tools are dropped in the vicinity of the container, no part of the container is exposed to possible breakage. The lid can be removed, the container may be opened and a siphon inserted. The lid may then be replaced onto the carrier and the siphon fed through the access hole in the lid.

The method of making the container of the present invention includes a blow-molding process by which the container is made in one piece. The lid is then separated from the carrier and trimmed so that the cooperating portions of the lid and body may conveniently engage one another to form a tight lid for the carrier.

The design herein disclosed is believed to be superior in several major respects to those presently available. These design advantages, to be discussed below, can be more easily appreciated by referring to the accompanying drawings.

BRIEF DESCRIPTION OF THE DRAWINGS

FIG. 1 is a perspective view of the protective carrier, with lid attached.

FIG. 2 is a perspective view of the upper portion of the protective carrier, without the lid.

FIG. 3 is a perspective view of the bottom of the protective carrier.

DESCRIPTION OF THE PREFERRED EMBODIMENT

Figure 4:
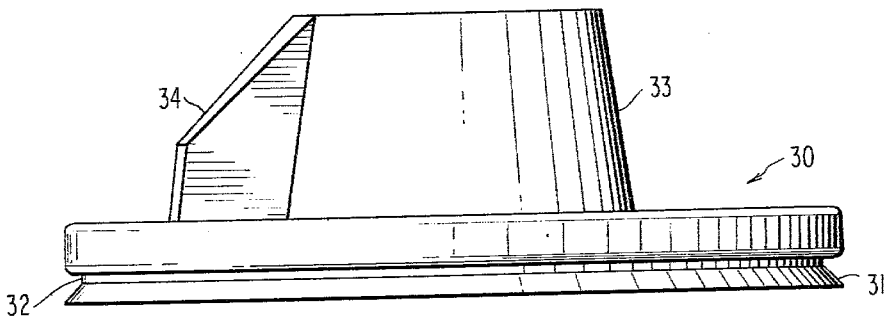
FIG. 4 is a perspective view of the lid.

Referring to the Figures wherein like numerals are employed for like components in the several views, FIG. 1 shows the protective carrier with its lid in place. The carrier body 10 and lid 30 are made from a low density polyethylene, and are of a thickness sufficient to give a high degree of structural rigidity. Carrier body 10 is generally bucket-shaped, with a series of spaced, linear ribs 12 and 13 molded into the sides and bottom of the carrier body. These inwardly-directed ribs reinforce the structural rigidity of the carrier body, and, in addition, act as contact surfaces between the carrier body and the glass container being carried, and thereby serve to isolate the glass container and the carrier body from one another. In situations in which the glass container would be subjected to crushing-type forces, these ribs, of generally U-shaped cross section, would act as stiffening agents around the periphery of the carrier and tend to resist carrier body wall deformation. Under situations in which the glass container would be vulnerable to impact-type forces, including those generated by dropping, the ribs maintain a protective air space around most of the glass container and allow the local deformation of the carrier body to absorb energy from the impact with minimal damage to the glass container within.

As can be seen from FIG. 3, the shape of the side ribs 12 is somewhat different from the shape of the ribs 13 found on the bottom of the carrier body. This was found advantageous in view of the probable weight distribution within the carrier. In an upright position, the entire weight of the glass container will rest on the bottom ribs. By sharpening the apex of the rib on the outside bottom of the carrier body, the corresponding inner rib surface, upon blow-molding, approaches a semicircular or V-shaped cross section, which would maximize rib strength with respect to forces directed to the bottom of the carrier body.

Again referring to FIG. 3, the bottom of the container body 14 has been designed to maximize container stability when the container is in an upright position. This has been accomplished in two ways. First, the bottom has been designed to present a relatively flat surface, substantially free of bumps or other surface projections such as mold marks, identification numbers, etc. In addition, the bottom design calls for a relatively small radius of curvature where bottom and side wall meet, as at 15. This will allow for more contact and support around the outer edges of the bottom, and will greatly increase the carrier's resistance to tipping.

Referring now to FIG. 2, handle 20 is made of a single piece of heavy gage metal rod having opposite ends 23 and 24. The rod should be of sufficient strength to resist permanent deformation under maximum forseeable loads—a mild steel rod of approximately 3/16 inch has been found staisfactory. A plastic covering on the handle is suggested to reduce slippage and offer some cushioning for the hand.

The handle 20 is prebent and attached to the carrier body 10 through a pair of opposing holes 21 and 22 in the body 10. Each end of handle 20 is prebent in two places, with a small portion of the handle projecting approximately perpendicular through the carrier wall, and the end-most segment of each said projecting portion being bent so that each end segment of the handle ultimately lies along the inside surface of the carrier. It should be noted that the opposite ends of the handle 20, noted as 23 and 24 in FIG. 2, are bent so that, with the handle in the lifting position, ends 23 and 24 will be roughly horizontal, and will face in opposite circumferential directions. This serves to lock the handle to the carrier body by resisting any tendency for the handle to deform and pull free under extreme loads. Lip 25 extends around the circumference of the rim of carrier body 10, and is designed to afford a seal in cooperation with a corresponding circumferential rib, depicted as feature 32 on lid 30 in FIG. 4, and discussed in more detail below.

Figure 5:
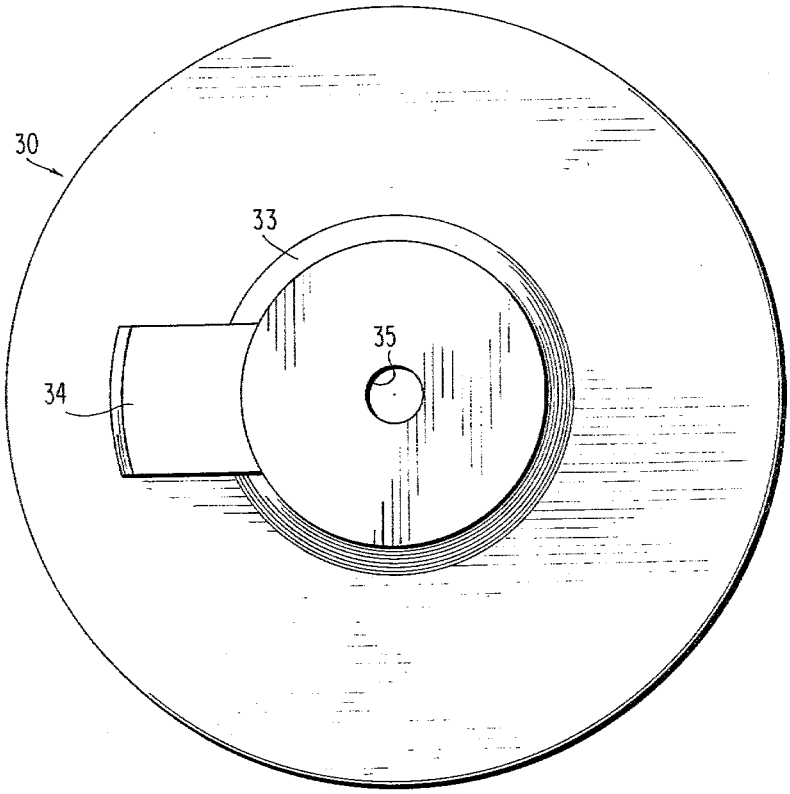
FIG. 5 is a plan view of the lid.

Lid 30 is depicted in FIGS. 1, 4 and 5. It is made of the same material, and in the same relative thickness, as carrier body 10. As can be seen in FIG. 4, the lid comprises a flange or skirt 31 extending from a circumferential rib 32. Rib 32 is designed to coact with corresponding circumferential lip 25 on carrier body 10 to provide removable engagement between said lid and said carrier body; with lid 30 placed on top of carrier body 10, downward pressure on the lid will cause rib 32 on lid 30 to "snap" over the protruding lip 25 of the carrier body, thus sealing the lid 30 to the carrier body 10. Subsequent release of this seal is facilitated by skirt 31, which increases available purchase and allows finger pressure to be more easily and directly applied to the seal to force rib 32 back over lip 25, permitting removal of the lid.

Lid 30 also comprises dome 33, which is of generally conical shape except for integral keyway area 34. The shape, position, and proportion of this dome are designed to protect the neck and carrying handle of standard glass laboratory solvent containers; when the lid is secured to the carrier body, this dome becomes part of a carrier system which can provide total protection against mechanical shock or other handling hazards. Keyway area 34 can accommodate a jug-type carrying handle, thereby protecting the handle of the container and constraining rotational motion of the container. The central aperture 35 in the top of dome 33 provides access to the container and its contents without having to compromise this total protection. The container in the carrier may either be opened conventionally and the lid to the carrier replaced after tubing or other delivery means has been installed through aperture 35, or a hole may be drilled or punched through aperture 35 into the top of the container, and tubing or other means installed without having to unseal lid 30 at all.

With respect to the method of manufacture, a blow-molding process has been used with considerable success, although it is not intended that fabrication of the subject carrier be limited to this process. In the blow-molding process, the selected material of composition, for example a polyethylene plastic, is heated to a molten state and formed into a hollow tube or parison. This hollow parison is suspended above a relatively thin hollow rod called a blow pin, and the parison is allowed to flow down around the blow pin in a cylindrical sheet. The molten plastic is not of uniform thickness to compensate for differences in the desired thickness of the final container, e.g., a relatively thick, strong bottom, and to compensate for the forces of gravity. At a precisely controlled time, a relatively air-tight mold is clamped around this cylindrical sheet of molten plastic, and air at high pressure is introduced from an aperture in the end of the blow pin. The resulting pressure forces the molten plastic to conform to the inside surfaces of the mold, thereby forming the plastic into the desired shape. It has been found convenient to form the carrier body and the lid as one structure, with a circumferential band of expendable material connecting the carrier body with the lid. The hole in the top of the lid is made as a convenient by-product of the overall blow-molding process. The blow pin, protruding into the central area of the mold from above, automatically forms a rough hole in the top of the carrier. This rough hole may then be trimmed during subsequent operations.

Once the plastic in the mold has cooled, the carrier-plus-lid structure is removed from the mold, and the lid is separated from the carrier body by cutting along a line parallel to the carrier body top and the lid bottom, directly through the approximate midpoint of the circumferential band of expendable material. The expendable material may then be trimmed from both lid and carrier body so that lid and carrier body may then be snapped together and used as a unit.

It is claimed:

1. A protective carrier for housing a fragile container, said carrier comprising:

(a) a hollow body having a generally cylindrical side wall having edges defining a first end and a second end for said body;

(b) a bottom provided integrally about the perimeter of said first end;

(c) a plurality of inwardly extending ribs on said wall for supporting the perimeter of the container to be housed;

(d) a plurality of inwardly projecting ribs on said bottom for supporting the bottom of the container to be housed;

(e) a lid adapted for removable engagement with said second end of said body, said lid including a raised central portion for surrounding and protecting the neck of the container; said raised central portion extending upwardly above the top of the neck to provide total protection to the container; and (f) a handle attached to said body at two generally opposing positions near said second end of said body;

(g) said handle including at each end thereof a first portion extending through said side wall of said body in a direction substantially perpendicular to said side wall, and a second portion extending substantially perpendicular to said first portion, (h) said second portions being formed so that when said handle is in its lifting position said second portions are approximately horizontal and extend in opposite directions.

2. The protective carrier of claim 1 wherein:

(a) said body has a lip extending about the perimeter thereof at said second end;

(b) said lid includes a rib adapted to snap over said lip for holding said lid in position; and (c) said lid further includes a skirt extending downwardly and outwardly from said rib for providing a surface engageable by the fingers to facilitate release of said rib from said lip.

* * * * *